United States Patent [19]

Wardle

[11] 4,137,657

[45] Feb. 6, 1979

[54] SHIELD AND AWARD DESIGNATION MOUNTING DEVICE

[76] Inventor: Peter Wardle, 1 Joel Ct., Huntington Station, N.Y. 11746

[21] Appl. No.: 756,349

[22] Filed: Jan. 3, 1977

[51] Int. Cl.[2] ..... A44C 3/00

[52] U.S. Cl. ..... 40/1.5; 40/20 A; 40/605

[58] Field of Search ..... 40/1.5, 1.6, 5, 20 R, 40/20 A, 140 R, 142 R, 143 R, 125 R, 618, 620, 622, 602

[56] References Cited

U.S. PATENT DOCUMENTS

| | | | |
|---|---|---|---|
| 1,217,192 | 2/1917 | Larson et al. | 40/140 |
| 1,775,725 | 9/1930 | Keith | 40/140 |
| 2,707,344 | 5/1955 | Bolognese | 40/1.5 |
| 3,193,956 | 7/1965 | Przybysiski | 40/1.5 |

FOREIGN PATENT DOCUMENTS

| | | | |
|---|---|---|---|
| 2281614 | 3/1976 | France | 40/1.5 |

*Primary Examiner*—John F. Pitrelli
*Assistant Examiner*—G. Lee Skillington
*Attorney, Agent, or Firm*—Stephen E. Feldman; Marvin Feldman

[57] ABSTRACT

A shield mounting plate is formed to accent and mount an official shield, of the type worn by a police officer, fireman or the like person; and to facilitate attachment of the shield to such person. The upper edge of the mounting plate is further formed to mate with and mount an award designation mounting strip upon which a bar type symbol designating an award, as for bravery, markmanship, or the like may be secured. Each award designation mounting strip is formed to mate and be mounted to the shield mount, or to another award designation mounting strip and also to mate with and mount another award designation mounting strip such that a unitary device may be formed to mount not only the shield but also a selected number of award designations. Alternatively, there is shown a modified award designation mounting strip for mounting a number of awards in a line and for attachment to other similar award designation mounting strips to form a unitary device for mounting only award designations and securing same to the wearer separate from a badge or shield.

8 Claims, 4 Drawing Figures

FIG. 1
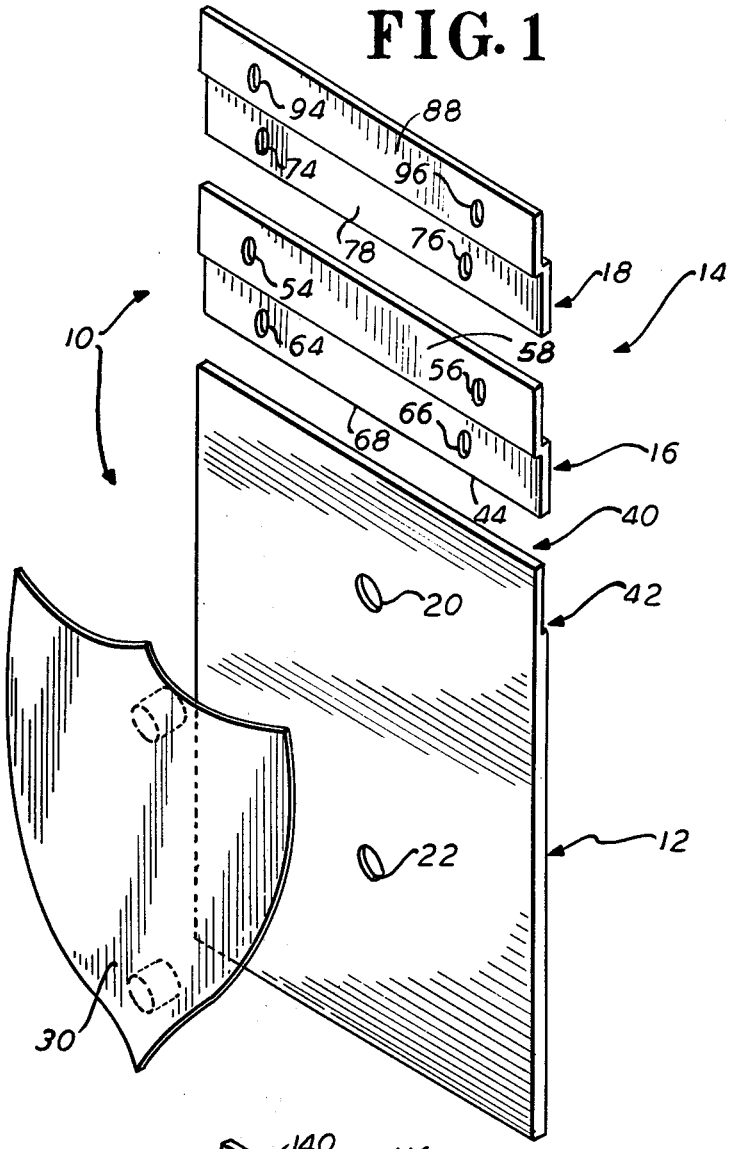
FIG. 2
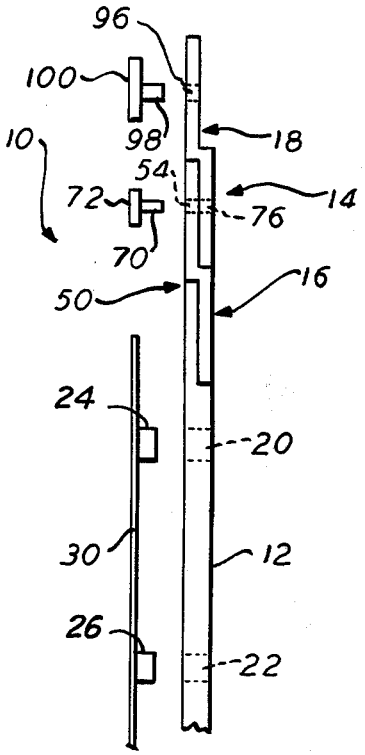
FIG. 4
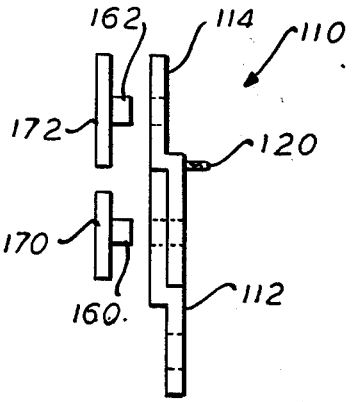
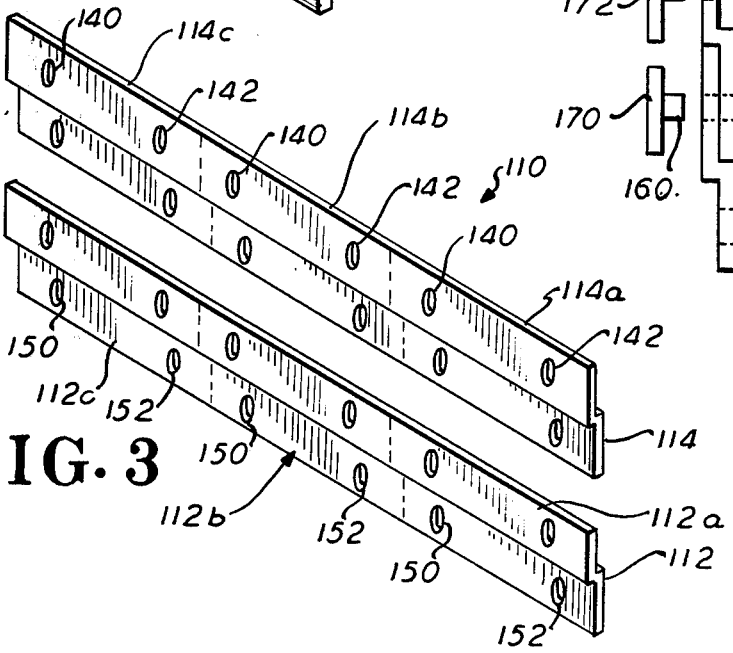
FIG. 3

SHIELD AND AWARD DESIGNATION MOUNTING DEVICE

BACKGROUND OF THE INVENTION — FIELD OF APPLICATION

This invention relates to mounting devices for shields, badges, or the like; and more particularly to devices for mounting shields and award designations in proper disposition with respect to each other and upon the wearer thereof.

BACKGROUND OF THE INVENTION — DESCRIPTION OF THE PRIOR ART

Many persons in today's society serve in an official capacity. Of those persons a goodly number perform their services in a manner which brings them in contact with other people; and which requires that they be able to quickly and readily identify themselves, and the capacity in which they serve. It has therefore become commonplace to provide such persons with identification in the form of official badges or shields of the type utilized by policemen, firemen and the like.

When such badges or shields are worn on the person's uniform, whether it be a jacket or shirt, they must be displayed in easy view of all who may come in contact with such person. Obviously, since the wearer's garment may be changed from day to day the badge or shield must be moved to the new garment since only one badge or shield is issued to each person. This creates a problem of attachment and removal which has generally been resolved by attaching to the wearer's garment a piece of material with a pair of spaced holes to accept the pin or other securing means provided with the shield.

Proper wearing and display of one's badge or shield becomes a problem when the wearer has also received one or more symbols designating awards or commendations for things like marksmanship, bravery, years of service, or the like. These designation symbols may either be strips or bars of one or more colors, or they may be symbols like a rifle, pistol, wreath or similar pictorial appearance related to the award. The wearer in most instances is desirous of showing off their accomplishments; while at other times is required to do so. In either instance the award designations must be properly worn, and worn in proper relationship to each other and to the shield.

To merely pin on the shield, and each such award designation, to one's uniform each day presents a cumbersome and time consuming chore. Relative spacing and alignment present a problem if the user is not to look sloppy and is to pass inspection. In addition the numerous pin holes in one's uniform take their toll and eventually will require replacement thereof. If the uniform is of relatively heavy material such as a jacket or winter shirt it may be difficult to push the pin of the shield or award designation therethrough and the pins can break and require replacement of the designation.

In one prior art approach to this problem, as shown in U.S. Pat. No. 1,550,329 granted on Aug. 18, 1925 to W. D. M. Simmons for Badge, the shield is suspended from a carrier which is, in turn, adapted to mount and display a number of award designation strips. The device is not only relatively large and cumbersome; but the suspended shield may easily be separated and lost, and the carrier will present an unnecessary and ugly looking empty plaque until awards have in fact been earned, if ever.

Some devices exist for interconnecting only award designation strips. One such device is shown in U.S. Pat. No. 2,707,344 granted in May 3, 1955 to A. Bolognese for Mounting Device For Service Ribbons. Such devices are, however, not adaptable for mounting only one award designation above the other, require the use of rivets, screws or bolts, which may not be available and still leave the user with a second mounting device which must be aligned with the shield if one is wearing both a shield and award designations.

There are also available unitary shield and award mounting devices such as shown in U.S. Pat. No. 3,193,956 granted to E. Przybysiski on July 13, 1965 for Device For Properly Mounting Award Bars On Uniforms. Such devices are, however, each formed for a designated number of award bars and thus requires a different mounting device for each possible number of award bars. If a new award is given the user cannot properly display same until obtaining a new mounting device. If an award is taken away or the recipient misplaces the designation then a different mount is required or the blank space on the mount will look unsightly and cause the wearer to fail inspection.

SUMMARY OF THE INVENTION

It is, therefore, an object of this invention to provide a new and improved mounting device for a badge or shield.

It is another object of this invention to provide a new and improved mounting device for both a badge or shield and symbols designating an award or commendation or nameplate.

It is a further object of this invention to provide a new and improved device for mounting an official badge or shield in proper position with respect to one or more symbols designating an award or commendation.

It is a still further object of this invention to provide a new and improved device for mounting a badge or shield, and to which there can be selectively and easily secured at least one device upon which a symbol designating an award can be mounted.

It is yet still a further object of this invention to provide a new and improved device for mounting a badge or shield, and to which there can be selectively and easily secured an award mounting strip which not only can mount a symbol designating an award but can also receive, mate with and mount another award mounting strip; and with each such award mounting strip adapted to receive, mate with and mount another award mounting strip.

The invention involves a shield mounting device formed to mate with and mount an award mounting strip, which is in turn formed to mate with and mount another award mounting strip; to thus form a unitary device for mounting a shield and a selected number of symbols designating awards or commendations.

Other objects, features, and advantages of the invention in its details of construction and arrangement of parts will be seen from the above, from the following description of the preferred embodiment when considered in conjunction with the drawing, and from the appended claims.

BRIEF DESCRIPTION OF THE DRAWING

In the drawing

FIG. 1 is an exploded perspective drawing of a shield mounting plate and a pair of award mounting strips which embody the instant invention.

FIG. 2 is a side elevational view of the shield mounting plate and pair of award mounting strips of FIG. 1 interconnected into a unitary device.

FIG. 3 is an exploded perspective view of a modified pair of award mounting strips; and FIG. 4 is a side elevational view of the pair of modified award mounting strips of FIG. 3 interconnected into a unitary device.

DESCRIPTION OF THE PREFERRED EMBODIMENT

For convenience the invention will be described as applied to a shield mounting plate of generally rectangular configuration formed from plastic and with its upper edge formed to mate with and be glued to an award strip, also of generally rectangular configuration and also formed of plastic, by a lap-type joint. The award strip is in turn formed along its upper edge to mate with and be glued to another similarly formed award strip so that any selected number of award strips may be secured to each other and to the shield mounting plate to form a unitary device. It should be understood nevertheless that without departing from the scope of the invention that the shield mounting plate, and award strips, may be formed of any suitable material such as metal, leather, or the like; that they may be of any convenient configuration commensurate with the shield and award symbols to be mounted; that they may be formed with mating edges of other configurations as long as such edges come together to form a unitary device with a relatively flat and contiguous surface; and that any or more than one edge of the shield mounting plate and or award strips may be so formed to mate with the device to be secured thereto.

With reference to FIG. 1 there is generally shown at 10 a shield and award mounting device including a shield mounting plate 12 and an award mounting assembly 14 consisting of a pair of award symbol mounting strips 16, 18.

Shield mounting plate 12, and award strips 16, 18 are formed from suitable plastic such as high impact styrene, nylon, celluloid or other suitable material. Preferably such material should be clear but if desired may be colored black, blue or any color compatible with the garment upon which device 10 is to be worn. Plate 12, and strips 16, 18 may also be formed from metal, leather or other suitable material. The material from which plate 12 and strips 16, 18 are formed should also be flexible and able to withstand as much as a 60° bend without cracking. The formation of plate 12 and strips 16, 18 can be accomplished by molding, extruding or any other suitable forming process.

Shield mounting plate 12 is formed with a pair of apertures 20, 22 to accept lugs 24, 26 respectively (FIG. 2) of shield or badge 30. Each such lug is conventionally formed with a hole so that when badge 30 is positioned on plate 12 with its lugs 26, 28 extending through apertures 20, 22 of plate 12 said lugs will also extend through holes provided in the garment of the wearer to accept therebetween a safety type pin to secure shield 30 and plate 12 to the wearer's garment. Alternatively, badge 30 may carry its own pin type clasp; and in that instance the pin thereof would be passed through apertures 20, 22 to secure the shield and mounting device 10 to the wearer's garment.

Upper edge 40 of mounting plate 12 is formed with a groove 42 extending across the longitudinal extent thereof to form one half of a lap-type joint. The other half of the lap-type joint constitutes a groove 44 formed across the extent of award mounting strip 16. As such when grooves 42 and 44 of plate 12 and strip 16 are mated and secured together as by a suitable glue or epoxy a unitary device is formed with a relatively flat face surface 50.

A pair of apertures 54, 56 are formed in award mounting portion 58 of strip 16 and a similar pair of apertures 64, 66 are formed in securing portion 68 of strip 16. Apertures 54, 56 are positioned and formed to receive lugs 70, (FIG. 2) of award symbol 72 in a manner similar to that of shield 30. Alternatively, apertures 54, 56 could receive a safety type pin if award symbol 72 was provided with one.

Apertures 54, 56 are also positioned for alignment with a pair of similarly formed apertures 74, 76 formed in securing portion 78 of strip 18; so that should securing portion 78 be mated with and behind mounting portion 58 of strip 16 and strip 18 secured to strip 16, as by gluing, the attaching device for award symbol 70 may pass through the aligned apertures 54, 74 and 56, 76. The mounting portion 88 of strip 18 is similarly formed with aligned apertures 94, 96 to receive attaching means 98 of award symbol 100.

Thusly a unitary device 10 may be formed for mounting a shield 30 and to which may be mounted any selected number of award symbol designations 72, 100. This is accomplished by merely securing a first award mounting strip 16 to plate 12, and then securing an additional strip 18 to each preceeding strip 16 or 18; until the desired number of award mounting strips are attached to plate 12. The unitary device 10 may then be secured to the wearer's garment by the attaching means provided for shield 30 or by separate attaching means, such as a safety type pin, secured to the back of device 10.

If desired award mounting strips may be formed for use separate from the shield mounting plate as shown at 110 in FIGS. 3 and 4. Each award mounting strip may either be formed to accept a single award symbol, as shown for strips 16 and 18 of FIGS. 1 and 2, or they may be formed to mount multiple award symbols as shown at 112*a*, 112*b*, 112*c*, and 114*a*, 114*b*, and 114*c* in FIG. 3. Each strip 112, 114 is formed to mate with an adjacent strip (FIG. 4) and to be secured thereto as by glue, epoxy or the like. In addition at least one such strip may have secured to its rear surface an attaching device such as a safety type pin 120 (FIG. 4).

Pairs of aligned apertures 140, 142 and 150, 152 are formed in strips 112, 114 as described for strips 16 and 18 to receive attaching means 160, 162 of award symbols 170, 172 as described for the embodiment shown in FIGS. 1 and 2.

From the above description it will thus be seen that a novel and improved shield and award symbol mounting device has been shown, which device is simple in construction and use and is readily sized to accommodate any selected number of award symbols.

It is understood that although I have shown the preferred form of my invention that various modifications may be made in the details thereof without departing from the spirit as comprehended by the following claims.

I claim:

1. A mounting device for a shield and/or award designations comprising:

(a) a first mounting means formed to receive and mount a symbol;

(b) a second mounting means formed to receive and mount a symbol;

(c) mating means formed on said first mounting means and said second mounting means to facilitate disposition of said first mounting means and said second mounting means in proximity to each other so as to present a unitary appearance with a substantially contiguous surface when so positioned; wherein said mating means includes a lap-type joint formed between said first mounting means and said second mounting means, said lap-type joint includes a groove formed along one edge of said first mounting means and a similar groove formed along one edge of said second mounting means, and wherein said groove on said first mounting means is formed along its upper edge and in the rear surface thereof, and said groove on said second mounting means is formed along its lower edge and in the face surface thereof, and wherein said second mounting means also includes a groove formed along the upper edge thereof and in the rear surface thereof for mating with the groove formed on the lower edge and face surface of another second mounting means; and (d) adhesive securing means for securing said first mounting means and said second mounting means together when so disposed.

2. The device of claim 1 including attaching means for attaching the device to another item.

3. The device of claim 2 wherein said attaching means is carried by said first mounting means.

4. The device of claim 1 wherein said first mounting means is of plate like rectangular configuration and formed to mount a shield; and said second mounting means includes at least one mounting strip of rectangular configuration and formed to mount a symbol designating an award.

5. The device of claim 4 wherein said second mounting means includes a plurality of mounting strips each of rectangular configuration and each formed to mount a symbol designating an award.

6. The mounting device of claim 1, said first and second mounting means being formed with a plurality of holes to receive and mount said symbols, and wherein at least one hole on said first mounting means is coaxial to one hole on said second mounting means so as to receive and mount one of said symbols therethrough.

7. The mounting device of claim 6, said first and second mounting means being identical.

8. The mounting device of claim 1, wherein the symbol is received and mounted with the overlapping first and second mounting means.

* * * * *